United States Patent [19]

Goodwin, Jr. et al.

[11] 4,292,633

[45] Sep. 29, 1981

[54] TWO-WIRE ISOLATED SIGNAL TRANSMITTER

[75] Inventors: Perry H. Goodwin, Jr., Dana Point; Richard J. Kotalik, Santa Ana, both of Calif.

[73] Assignee: Robertshaw Controls Company, Richmond, Va.

[21] Appl. No.: 963,194

[22] Filed: Nov. 24, 1978

[51] Int. Cl.[3] ..... G08C 19/02; G08C 25/02

[52] U.S. Cl. ..... 340/870.39; 340/310 R; 340/870.01; 340/870.42; 363/124

[58] Field of Search ..... 340/177 R, 210, 209, 340/186, 310 R; 330/211, 187, 10; 324/118; 361/245, 246; 310/47; 323/19; 363/15, 124; 325/492; 455/343

[56] References Cited

U.S. PATENT DOCUMENTS

| | | | |
|---|---|---|---|
| 3,424,981 | 1/1969 | Erdman | 330/10 |
| 3,483,476 | 12/1969 | Kobayashi | 330/10 |
| 3,581,184 | 5/1971 | Hurd | 330/10 |
| 3,757,195 | 9/1973 | Sklaroof | 330/10 |
| 3,835,408 | 9/1974 | Shaffer | 330/10 |
| 3,931,582 | 1/1976 | Kato et al. | 330/10 |
| 3,956,707 | 5/1976 | Bruyére | 330/10 |
| 3,959,786 | 5/1976 | Chana | 340/210 |
| 3,973,202 | 8/1976 | Gardner | 325/492 |
| 4,000,473 | 12/1976 | Saito | 330/10 |
| 4,024,452 | 5/1977 | Seidel | 363/15 |
| 4,030,041 | 6/1977 | Sasaki | 330/10 |
| 4,087,758 | 5/1978 | Hareyama | 323/19 |

*Primary Examiner*—James J. Groody

*Attorney, Agent, or Firm*—Fulwider, Patton, Rieber, Lee & Utecht

[57] ABSTRACT

A two-wire signal transmitter which isolates for direct current voltages the transducer input circuitry from the transmitter output circuitry. The transmitter superimposes a controlled current signal on the two-wire transmission line which also conducts a direct current power supply voltage to the transmitter. The direct current power supply voltage is transferred to the transducer input circuitry by means of a series direct current to alternating current and alternating to direct current conversions using a transformer for direct current isolation. The direct current transducer input voltage is converted to an alternating current voltage prior to any active signal processing with the processed or any current signal being transferred to the transmitter output circuitry through a direct current isolation transformer. The transferred alternating current signal is converted to a direct current signal by a synchronous detector. A matched dual current generator is utilized in the transducer input circuitry and in the zero reference circuitry to minimize unequal drift due to environmental temperature changes.

8 Claims, 2 Drawing Figures

TWO-WIRE ISOLATED SIGNAL TRANSMITTER

BACKGROUND OF THE INVENTION

1. Field of the Invention

The present invention relates generally to two-wire signal transmitters for telemetry and, more particularly, to transmitters which provide direct current isolation between the transducer input circuitry and the transmitter output circuitry.

2. Description of the Prior Art

In the past, relatively small transducer voltages such as those from temperature sensing thermocouples, or the like, were amplified or processed at their source before being transmitted to the remote indicating location. In a particular type of telemetry system, the transmission line between the transmitter and the indicating location not only conducts the processed transducer signal but also conducts operating power to the transmitter itself. Such a system is conventionally known as a "two-wire" system to indicate that signals may be transmitted in both directions simultaneously.

In some cases, the transducer may be connected to a device which is maintained at a direct current voltage which is considerably different than that of the indicating location. In such cases, the signal transmitter must be direct current voltage isolated from the transmission line. An additional reason for maintaining direct current isolation is that spurious voltages such as those from lightning may occur on long transmission lines which would adversely affect the normally delicate circuitry of the signal transmitter.

A particular class of two-wire telemetry system to which the present invention is generally related which is basically conventional is that of temperature sensing in which a common direct current power supply at the indicating location provides the direct current operating voltage to one or a plurality of transmission lines to power the respective temperature signal transmitters. In such a system, the transducer signal typically controls the current in the transmission line which is sensed at the remote location to provide an indication of the signal. Illustrative systems of this type are shown in Kobayashi et al, U.S. Pat. No. 3,483,476, which illustrates the basic technique of isolating the input signal processing circuitry from the output circuitry connected to the transmission line and providing power to the input signal processing circuitry by means of a direct current to alternating current to direct current conversion technique using an isolating transformer in the alternating current circuitry. A similar technique is used in converting the signal from direct current in the input circuitry to direct current in the transmitter output circuitry.

An example of a more recent technique utilizing the same principles is shown in Chana, U.S. Pat. No. 3,959,786, which provides power to the input signal circuitry by means of an oscillator driving a transformer, the secondary of which includes rectifiers to generate the direct current voltage necessary to operate the input circuitry. The input signal itself is processed in the direct current mode till applied to the primary of a current transformer which is operated as a chopper by connecting it to the terminals of the secondary of the power transformer. The resultant alternating current signal on the secondary of the signal transformer is rectified and applied to a series current generator in the transmission line.

A further aspect of such a two-wire temperature telemetry transmitter is that, while a number of different transducers are available for temperature sensing, the temperature correspondent signals from these transducers are typically quite small, in the millivolt range for thermocouples, for example, and that temperature changes produce relatively small changes in those millivolt signals. Similarly, while a resistance temperature detector may have a substantial reference resistance, temperature changes typically produce relatively small changes in the resistance detector. Another aspect of temperature sensing is that the transmitter circuitry must operate over a relatively wide range of environmental conditions with attendant, component variations.

There has been a need in the field of telemetry signal transmitters for two-wire systems in which the transducer signal is relatively small for a transmitter system which provides precise and stable telemetry signals to the transmission line for a wide range of operating conditions including direct current isolation of the transducer from the transmission line. The present invention provides such a system.

SUMMARY OF THE INVENTION

The two-wire isolated signal transmitter of the present invention provides extremely stable and reproducible millivolt signal processing over a wide range of environmental temperatures by utilizing stabilized and matched dual current generators in the passive input circuitry and passive zero reference circuitry and immediately converting the difference signal to an alternating current signal before further processing by active elements. Direct current voltage isolation between the transducer input circuitry and the transmitter output circuitry is effected by a power isolation transformer and a signal isolation transformer. Thus, the signal processing and amplification, is done in the alternating current mode substantially reducing errors due to drift in the characteristics of the processing components due to operating environment changes. Signal processing in the direct current mode, such as at the transmitter output, is effected when the relatively small transducer signals have been amplified to the point where errors caused by component drift are negligible.

Another feature of the transmitter of the present invention is the conversion of the processed alternating current signal to a direct current signal for use by the transmitter output by means of a synchronous detection technique utilizing a field effect transistor which can be operated as a switch providing either an open circuit or a short circuit over the entire ambient temperature range of the transmitter. Thus, the conversion of alternating current signals to direct current signals are not dependent upon the temperature coefficients of such devices as diodes which could introduce variable errors.

A further feature of the present invention is that a plurality of sensing transducers, for temperature in the presently preferred embodiment, may be utilized as input devices to the transmitter. For the illustrated embodiment, the input may be provided by a voltage source in the millivolt range, a variety of thermocouples and a variety of resistance temperature detectors. For each input device selected, only certain passive resistive elements in the input circuitry and in the zero reference circuitry need be changed due to the operation of the matched dual current generators. Thus, a plurality of basic transmitter units may be constructed and a transmitter for a particular selected input transducer finally constructed by adding relatively few passive resistance elements.

Another feature of the present invention is that the current modulation of the transmission line is in the shunt mode so that the direct current power supply voltage on the line is applied directly to the power supply circuitry of the transmitter and the current modulation may vary over a wide range without effecting the supply voltage.

These and other features of the present invention will become apparent from the consideration of the following description of the presently preferred embodiment.

DESCRIPTION OF THE PREFERRED EMBODIMENT

Figure 1:
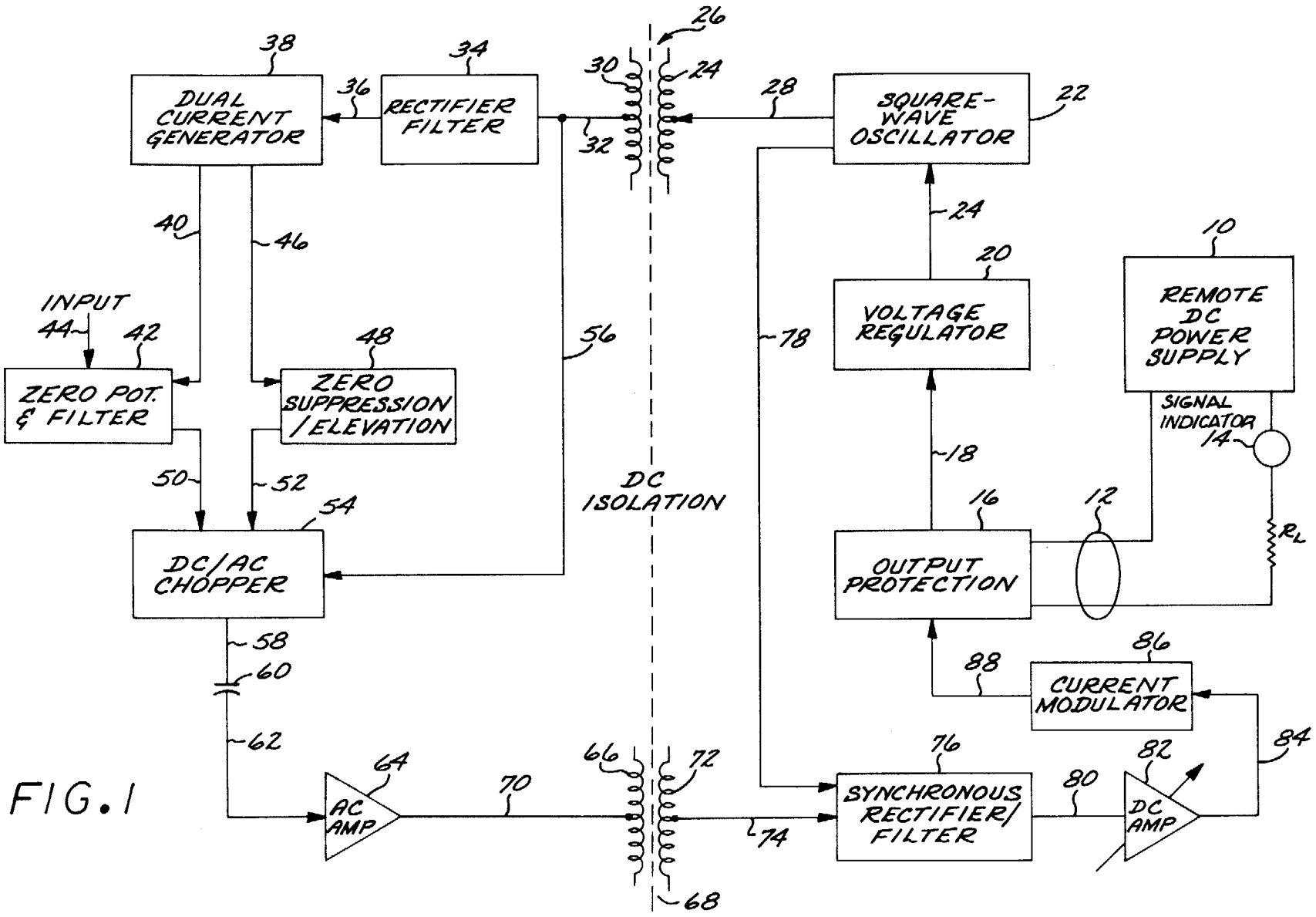
FIG. 1 is a block diagram of the two-wire isolated signal transmitter of the present invention.

Turning now to the drawings, particularly FIG. 1, thereof, the two-wire isolated signal transmitter is shown in block diagram form. As discussed above, the transmitter is connected to a remote DC power supply 10 through a transmission line 12 and a remote indicating device 14. The complete circuit includes some minimum overall line resistance RL which will be discussed in more detail below.

The voltage across the transmission line 12 provides the operating power for the transmitter in both the isolated transducer signal input circuitry and in the transmitter output circuitry. As such, the voltage across the transmission line 12 is connected through an output protection section 16, which will be discussed below, on a line 18 to a voltage regulator 20 which maintains the supply voltage for the transmitter at a predetermined value. The regulated voltage from the regulator 20 not only supplies all of the power requirements of the transmitter output circuitry but also supplies, through an isolated conversion system, the power requirements for the transducer input circuitry. This is effected by means of a direct current to alternating current converter, such as a square wave oscillator 22 which receives its power through line 24 from the voltage regulator 20. Square wave oscillator 22 drives the primary winding 24 of a power transformer 26 through a fictitious line 28 with the secondary 30 of transformer 26 receiving corresponding but isolated voltages.

The alternating current voltages appearing in the secondary 30 of power transformer 26 are connected through a line 32 to a rectifier-filter 34 which generates direct current voltages to operate the transducer signal input circuitry. A stabilized direct current voltage from the rectifier filter 34 is applied through a line 36 to a dual current generator 38 which supplies matched and regulated current sources for accurately sensing and measuring the millivolt input voltages from the transducers used with the transmitter. As such, the controlled current source is connected through a line 40 to a zero potentiometer and low pass filter section 42 to which the input signal from the transducer is connected through a line 44.

Similarly, a second controlled current source is connected through a line 46 to a zero suppression and elevation section 48, the operation of which will be described in detail below.

The output of the low-pass filter section 42 and zero suppression and elevation section 48 are connected through respective lines 50 and 52 to a direct current to alternating current chopper 54. It should be appreciated that the voltage on line 50 represents the voltage input from the transducer while the voltage on line 52 represents a chosen reference voltage level typically chosen to be zero on the remote indicator 14. The difference between the voltage levels on lines 50 and 52, therefore, represents a deviation from the zero reference level and typically is in the low millivolt range. The direct current to alternating current conversion in the chopper 54 is effected by means of alternating current voltages connected through a line 56 from the secondary 30 of the power transformer 26. The resultant output voltage from the chopper 54 is an alternating current signal on a line 58 alternating current coupled through a capacitor 60 and line 62 to an alternating current amplifier 64. Amplifier 64 increases the level of the alternating current signal sufficiently to drive a primary winding 66 of a signal transformer 68 through a fictitious line 70.

The output voltage in the secondary 72 of the power transformer 68 is connected through a fictitious line 74 to a synchronous rectifier/filter 76. It should be appreciated that the voltage on line 74 has a close phasal relationship with the alternating current voltages on lines 70, 32 and 28. As such, the alternating current output of the square wave generator 22 has a close phasal relationship with the alternating current voltage on line 74. Therefore, the output of the square wave oscillator 22 is connected through a line 78 as the reference voltage for synchronous rectification by the rectifier 76. As noted above, synchronous detection is utilized so that the resultant direct current voltage on line 80 will not be dependent upon the variable temperature coefficient characteristics of typical detecting devices such as diodes.

The direct current signal on line 80 is connected through a variable gain direct current amplifier 82 which may be adjusted for a particular correspondence between the range of voltages generated by the transducer and the desired variation in the indication of the indicating device 14. The range set amplified direct current voltage on line 84 is then applied to a current modulator 86 which, in effect controls the current in the transmission line 12. Thus, the output on line 88 from the current modulator is connected through the output protection section 16 to transmission line 12. In a two-wire system, the total current in the line 12 is limited by the impedances of the indicating devices 14 as adjusted by RL.

It should be appreciated from the above discussion that, the two-wire signal tranmitter of the present invention contains a plurality of features which minimize the error in correspondence between the transducer input signal on line 44 and the resultant current change in the transmission line 12 due to environmental or remote power supply variations. A dual constant current generator 38 is utilized to drive both the input circuitry and the zero reference setting circuitry so that environmental changes will "track" in the passive circuit elements thereby reducing error. Further, the transducer direct current signal voltage is immediately converted to an alternating current voltage to substantially minimize any environmental drift in a direct current signal processing circuit. The more easily controlled alternating current voltage is then amplified and transferred through an isolating means to a synchronous detector using components which do not exhibit temperature changes. The voltage regulator controlling the operating voltages for the entire transmitter result from a voltage regulator which produces a stable output voltage over a relatively wide range of input voltages from a remote direct current power supply.

A further feature is the use of an array of passive circuit elements in both the signal input circuits and in the zero reference circuits so that a single transmitter may be constructed to operate with a plurality of input transducers by simply presetting values for those passive elements.

Figure 2:
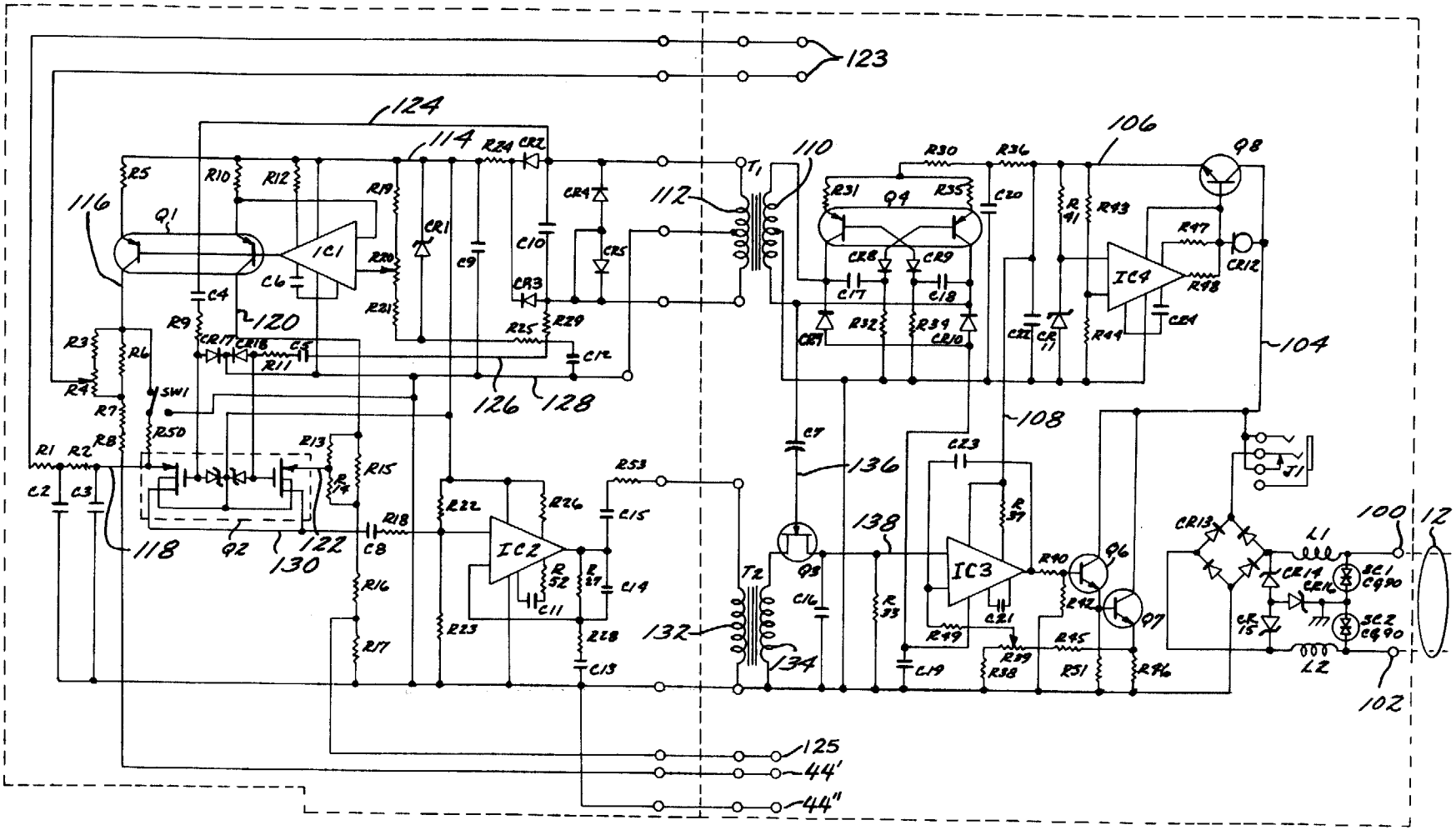
FIG. 2 is an electrical schematic diagram of the presently preferred embodiment of the transmitter.

FIG. 2 is a detailed electrical schematic diagram of a two-wire, isolated, signal transmitter constructed in accordance with the present invention. As shown, the transmission line 12 is connected to a pair of input terminals 100, 102, to the output protection section 16 (FIG. 1) which, in the detailed schematic diagram of FIG. 2, includes inductors L1 and L2, Zener diodes CR15, CR14 and CR16 and gaseous spark gaps SG1 and SG2. The output protection section 16 provides a shunt path to ground from both supply lines to shunt line transients due to lightning or high voltage impulses which may appear on the transmission line 12. The inner connection of the transmission line 12 is to opposite terminals of a bridge rectifier, CR13, the opposite terminals of which serve as the line input to the transmitter. The bridge rectifier CR13 is used to provide for transmission line inputs of either polarity so that transmission line polarity need not be taken into account when connecting the transmitter to the line.

The positive output of the bridge CR13 is connected through a test jack J1 on a line 104 to the voltage regulator 20 (FIG. 1) which in FIG. 2 is a shunt regulator circuit including operational amplifier IC4, transistor Q8, Zener diode CR11 and associated resistors R41, R43, R44, R47 and R48 and capacitor C24. The voltage regulator functions conventionally to provide substantially a regulated 8-Volt output on a line 106 to operate the transmitter circuitry while the input voltage on line 104 may vary widely, depending upon the voltage on the transmission line 12. For the embodiment shown, the voltage on line 104 may typically vary between 12 and 60 volts direct current and the regulator is designed to accommodate that range. Improved regulation is provided by utilizing the constant current diode CR12 in the base circuit of series transistor Q8. A first filter capacitor C22 filters the regulated voltage for a supply line 108 which supplies power to the output circuitry as will be described below. A pair of decoupling resistors R30 and R36 with a center filter capacitor C20, provide power to a square wave oscillator 22 (FIG. 1) which includes a dual transistor Q4 with associated components R31, R32, R34, R35, C17, C18, CR8 and CR9. The output load for the oscillator 22 is a primary winding 110 of a power transformer T1. For the embodiment shown, it has been found that an oscillator frequency of approximately 900 Hertz is optimum for both the component size required and the power requirements, though the exact oscillator frequency is not critical.

As discussed above with reference to FIG. 1, transformer T1 provides for the transfer of power from the output circuitry to the transducer input circuitry to a direct current to an alternating current to direct current conversion series and, therefore, the alternating current voltage appearing on the secondary 112 of power transformer T1 is rectified and filtered to provide a power supply for the input circuitry. Thus, the secondary 112 of transformer T1 is connected in a full-wave rectifier circuit including rectifier CR2 and CR3 resistor R24 and filter capacitor C9 to provide a basic positive operating voltage of approximately 8 volts on line 114. In addition, a highly regulated reference voltage for operating the input circuitry is provided by a Zener diode CR1, which requires a higher operating voltage than that provided by the general power line 114. Thus, a voltage doubler circuit including rectifier CR4, CR5, resistor R29 and filter capacitor C12 provide a voltage doubling circuit for operating Zener diode CR1. Connected across Zener CR1 is a string of resistors R19, R20, R21 and decoupling resistor R25 to the positive terminal or filter capaciter C12 to provide through variable resistor R20 a variable control voltage for the dual current generator 38 (FIG. 1).

The dual current generator 38 is constructed of a dual matched transistor Q1 driven by an operational amplifier IC1, the current output of the generator being determined by the setting of variable resistor R20. Operational amplifier IC1 further includes the frequency compensator components resistor R12 and capacitor C6. The output of operational amplifier IC1 is connected to the bases of the dual transistor Q1 the collectors of which form a matched source of constant current. One constant current line, 116, is connected to the input circuitry of the zero potentiometer and low-pass filter 42 (FIG. 1) which basically includes resistors R3, R4, R6, R7 and R8 in the zero adjusting portion and resistors R2 and capacitors C2 and C3 in the low pass filter section.

As was discussed above, certain passive elements, particularly resistors R6, R7 and R8, are determined by the type of transducer being used and the range over which it is to operate. Selection of component values for these elements is discussed below. In addition, switch SW1 is provided so that, in the event of thermocouple failure or opening of the thermocouple, the indicating meter will either go full scale or zero scale, depending on the position of switch SW1. Thus, the center terminal of switch SW1 is connected through resistor R50 to the source terminal 2 of chopper Q2 which also has a transducer input on a line 118 connected thereto. Chopper Q2 is a protected gate, dual MOSFET which is specially designed for this purpose and commercially available (Table 1).

A second constant current source line 120 from the dual current generator 38 is also connected through a series resistor array to provide a zero reference voltage which is connected as a second input on a line 122 to the chopper Q2. The zero reference voltage may be "suppressed" or "elevated" from a preset reference for various types of transducers, particularly thermocouples. Thus, the resistance array consists of resistors R13, R14, R15, R16 and R17 and, as discussed above, certain of these elements, namely, resistors R13, R14, R15 and R17 are selected on the basis of the particular transducer being used.

The voltages on lines 118 and 122 represent the input voltage and zero reference voltage, respectively, and the difference between these potentials represents the deviation in temperature from the desired zero reference. The transducer input is provided on lines 44' and 44''. In the embodiment of the invention depicted in FIG. 2, lines 123 and 125 are provided for alternative capabilities of operation. As the voltage difference is in the very small millivolt range, successful amplification requires that direct current voltage be converted to an alternating current voltage which is more easily amplified. Therefore, alternating pulses to the chopper are provided by connecting their gates to alternate sources of pulses which are provided by connecting the opposite sides of the secondary 112 of transformer T1 on lines 124 and 126, respectively, through pulse shaping circuits including capacitor C4 and resistor R9 and capacitor C5 and resistor R11, respectively, to the gates of the dual MOSFET chopper Q2. These pulses are clamped to circuit common line 128 by means of diode CR17 and CR18.

The resultant alternating current voltage on line 130 is connected through capacitor C8 and R18 to one input of an operational amplifier IC2 connected as an alternating current amplifier. Thus, the first input is biased to a particular voltage level by means of voltage divider R22 and R23 and alternating current amplifier IC2 includes the adjusting components R26, R52 and capacitors C11 and C14. The gain of amplifier IC2 is controlled by the series network consisting of R28 and C13, R28 being a variable component which is selected on the basis of the particular transducer selected, mainly the particular transducer's relative output compared to other transducers.

The output of amplifier IC2 is connected through a coupling network consisting of capacitor C15 and resistor R53 to the primary winding 132 of a signal transformer T2. Signal transformer T2 serves to direct current voltage isolate the alternating current signal appearing on its primary 132 and the signal appearing on its secondary 134.

The alternating current voltage appearing on the secondary 134 of transformer T2 is synchronously detected by means of a field effect transistor Q3 and filter capacitor C16 by means of switching transistor Q3 from the off state to the full "on" state by means of pulses derived from the square wave oscillator connected through its gate through capacitor C7 on a line 136. It will be noted that the phase relationships between the voltages appearing on the secondary 134 and those appearing on the output of the square wave oscillator are very closely related and that the operation of the synchronous detector is the equivalent of half-wave rectification except that the forward voltage drop of the field effect transistor Q3 is substantially zero for a very wide range of temperatures so that the forward voltage drop characteristics of other rectifying devices with variable temperature coefficients is avoided.

The detected alternating current voltage is filtered by capacitor C16 and resistor R33 and connected on a line 138 as a first input to a direct current amplifier IC3. In order to provide a higher operating voltage for current amplifier IC3, a higher negative polarity operating voltage is provided by tapping the oscillating voltage of the square wave oscillator at the transformer T1 terminals and rectifying that voltage by means of diodes CR7 and CR10 and a filter capacitor C19. Direct current amplifier IC3 is provided with the conventional adjusting circuits including resistors R37 and capacitors C21 and C23. To adjust the current span of amplifier IC3 for a particular transducer range, the second input to the amplifier is derived from a network, including variable resistor R39 together with resistors R49, R38, R45 and an emitter resistor R46. The output of current amplifier IC3 is connected to a Darlington pair power amplifier including transistors Q6 and Q7 and adjusting resistors R40, R42 and emitter resistor R46. The power current transistors Q6 and Q7 are connected in shunt across the transmission line 12 at the bridge network CR13 and therefore directly current modulates the current in the transmission line 12 regardless of the voltage applied or connected through line 104 to the voltage regulator 20.

Component values for the described transmitter, are given in Table 1 below. Component values for the adjustable resistance circuit elements are dependent upon the particular transducer type and its range. Considerations are the zero reference voltage desired, the absolute millivolt value output and the millivolt range for the desired indicator temperature range. These component values may be readily calculated by those skilled in the art. Component values for a particular transducer, are given in Table 2.

TABLE 1

| COMPONENT | |
|---|---|
| Element | Value |
| R1 | 10K |
| R2 | 10K |
| R3 | 5.11K |
| R4 | 10K POT |
| R5 | 4.6K |
| R9 | 56.2K |
| R10 | 4.6K |
| R11 | 56.2K |
| R12 | 5.1M |
| R18 | 5.11K |
| R19 | 75K |
| R20 | 100K POT |
| R21 | 499K |
| R22 | 499K |
| R23 | 499K |
| R24 | 200 |
| R25 | 4.42K |
| R26 | 1M |
| R27 | 10K |
| R29 | 200 |
| R30 | 100 |
| R31 | 200 |
| R32 | 49.9K |
| R33 | 49.9K |
| R34 | 49.9K |
| R35 | 200 |
| R36 | 200 |
| R37 | 5.1M |
| R38 | 1.24K |
| R39 | 5K POT |
| R40 | 100K |
| R41 | 3.34K |
| R42 | 100K |
| R43 | 24.9K |
| R44 | 100K |
| R45 | 20K |
| R46 | 100 |
| R47 | 5.1M |
| R48 | 20K |
| R49 | 4.99K |
| R50 | 22M |
| R51 | 10K |
| C1 | |
| C2 | 1.0mf |
| C3 | 1.0mf |
| C4 | .01mf |
| C5 | .01mf |
| C6 | .001mf |
| C8 | .1mf |
| C9 | 75mf |
| C10 | .001mf |
| C11 | 5pf |
| C12 | 10mf |
| C13 | 330mf |
| C14 | 150pf |
| C15 | 10mf |
| C16 | 1mf |

TABLE 1-continued

| COMPONENT | |
|---|---|
| Element | Value |
| C17 | .01mf |
| C18 | .01mf |
| C19 | 10mf |
| C20 | 10mf |
| C21 | .001mf |
| C22 | 22mf |
| C23 | 1mf |
| C24 | .001mf |
| CR1, 11 | 1N4566A |
| CR2-5, 7-10, 17, 18 | 1N4448 |
| CR12 | 1N5286 |
| CR13 | WO6 |
| CR16 | 1N4761 |
| Q1, 4 | TD401 |
| Q2 | MEM550C |
| Q3 | M1899E |
| Q6, 8 | 2N5550 |
| Q7 | 2N3019 |
| IC1-4 | CA3078 AT |
| SG1, 2 | CG90L |
| L1, 2 | 150mh |
| T1, 2 | 330-950-183 |

TABLE 2

| THERMOCOUPLE - TYPE 01 CHROMEL CONSTANTAN | |
|---|---|
| Element | Value |
| R101 | 64.30 |
| R6 | 368.8 |
| R7 | 175.7 |
| R8 | Jumper |
| R13 | Omit |
| R14 | Jumper |
| R15 | 368.8 |
| R16 | 360 |
| R17 | Jumper |
| R28 | 316 |

Thus, the two-wire isolated signal transmitter of the present invention will operate over a wide range of transmission line operating voltages with the transmitter output circuitry providing isolated direct current power for the transducer input circuitry, the input signal is directly connected to a chopper to avoid intervening processing errors and the amplified signal is transferred back in alternating current form to the output circuitry where it is synchronously detected with a substantially zero temperature coefficient device resulting in a direct current signal which is amplified and used to current modulate the transmission line 12.

While a particular presently preferred embodiment has been described in detail above, as well as an example of selection of variable component elements, it should be appreciated that numerous variations and modifications of the particular circuitry may be employed and that the invention is not to be limited except by the following claims.

What is claimed is:

1. A two-wire signal transmitter for connection to a two-wire transmission line having a direct current voltage impressed thereon, and transmitter comprising:

(a) transducer input circuit means for directly connecting as one input to said transmitter a transducer signal;

(b) reference voltage means for generating a reference voltage signal connected as a second input to said transmitter;

(c) comparator and converter means having as inputs said transducer signal and said reference voltage signal for providing an output as an alternating current signal indicative of the difference between said transducer signal and said reference voltage signal;

(d) alternating current amplifier means for amplifying said alternating current signal;

(e) signal transformer means having primary and secondary windings with said amplified alternating current signal connected to its primary winding for transferring said amplified alternating current signal to its secondary winding;

(f) alternating current to direct current synchronous detector means for converting the alternating signal in the secondary of said signal transformer means to a direct current signal;

(g) direct current amplifier means for amplifying said direct current signal;

(h) current modulator means for modulating a current in said transmission line in accordance with said amplified direct current signal;

(i) a power transformer having primary and secondary windings;

(j) direct current to alternating current power converter means for converting said direct current voltage on said transmission line to an alternating current power signal connected to said primary winding of said power transformer with said secondary winding of said power transformer connected to said comparator and coverter means as a converting drive signal thereto, and (k) alternating current to direct current power converter means for converting an alternating current signal in said secondary winding of said power transformer to a direct current voltage to power said transducer input circuit means

2. The signal transmitter defined in claim 1, wherein said alternating current to direct current power converter means includes dual current generator means connected both to said transducer input circuit means and said reference voltage means for supplying substantially equally operating currents to said transducer input circuit means and said reference voltage means.

3. The two-wire signal transmitter defined in claim 1 including bridge rectifier means connected across said transmission line and having as input thereto said current modulator means, whereby said current modulator means is connected directly across said transmission line.

4. The two-wire signal transmitter defined in claim 2 including:

bridge rectifier means connected across said transmission line and having as input thereto said current modulator means, whereby said current modulator means is connected directly across said transmission line.

5. The two-wire signal transmitter defined in claim 1 wherein:

said alternating current to direct current synchronous detector means connected to the secondary of said signal transformer means includes a field effect transistor having its source and drain terminals connected in series with said secondary of said signal transformer means and a filter circuit, the "on" "off" condition of said field effect transistor being substantially synchronously driven by said alternating current power signal applied to said primary of said power transformer.

6. A two-wire signal transmitter connected to a transmission line having a direct current voltage impressed thereon, said transmitter comprising:

(a) input circuitry for connecting said transmission line to transmitter output circuitry;

(b) a series voltage regulator connected to said input circuitry, said regulator reducing a regulated direct current power source for said transmitter output circuitry;

(c) oscillator means connected to said regulated direct current power source for generating an alternating current power voltage;

(d) isolating power transformer means having a primary winding connected to said oscillator means, and a secondary winding which is substantially direct current voltage isolated from said primary winding, the alternating current voltage impressed upon said primary winding appearing on said secondary winding;

(e) rectifier means connected to said secondary of said power transformer means for rectifying said alternating current voltage to produce an isolated direct current power source;

(f) a dual current generator connected to said isolated direct current power source, said generator having first and second outputs which are substantially equal and which have substantially equal temperature coefficients of change;

(g) a transducer input circuit connected between a first output of said dual current generator and a reference voltage point, a reference voltage circuit connected between said second output of said dual current generator outputs and said reference voltage point;

(h) a combined comparator-chopper for comparing an output from said transducer input circuit and said reference voltage circuit and chopping the resultant difference voltage to produce a substantially alternating current voltage, the chopping drive being derived from said secondary of said power transformer means;

(i) an alternating current amplifier having as its input the alternating current signal generated by said combined comparator-chopper;

(j) an isolating signal transformer having a primary winding connected to an output of said alternating current amplifier and having a secondary winding;

(k) a synchronous detector connected to said secondary winding of said signal transformer for producing a detected direct current signal corresponding to said alternating current signal in said secondary winding of said signal transformer;

(l) a direct current signal amplifier having as its input said detected direct current signal; and (m) a direct current power amplifier having as its input an output of said direct current signal amplifier and having its output connected across said transmission line.

7. A two-wire transmitter as defined in claim 6, wherein:

said synchronous detector includes a field effect transistor having source and drain terminals connected in series between said secondary of said signal transformer and a filter circuit and having its gate driving voltage derived from the output of said oscillator means.

8. A two-wire signal transmitter as defined in claim 6 wherein said input circuitry includes a full wave bridge circuit having said transmission line connected across one side of said bridge and the output of said direct current power amplifier connected across the other side of said bridge circuit, whereby the voltage on said transmission line may be of either polarity and said direct current power amplifier is connected directly across said transmission line.

* * * * *